US010166171B2

(12) United States Patent
Liu

(10) Patent No.: US 10,166,171 B2
(45) Date of Patent: Jan. 1, 2019

(54) ACUPUNCTURE DEVICE AND NEEDLE WAKENING METHOD

(71) Applicant: BOE Technology Group Co., Ltd., Beijing (CN)

(72) Inventor: Jiantao Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 235 days.

(21) Appl. No.: 15/100,047

(22) PCT Filed: Nov. 27, 2015

(86) PCT No.: PCT/CN2015/095789
§ 371 (c)(1),
(2) Date: May 27, 2016

(87) PCT Pub. No.: WO2016/180006
PCT Pub. Date: Nov. 17, 2016

(65) Prior Publication Data
US 2017/0119625 A1 May 4, 2017

(30) Foreign Application Priority Data
May 12, 2015 (CN) ..... 2015 1 0239818

(51) Int. Cl.
*A61H 39/08* (2006.01)
*A61H 39/00* (2006.01)

(52) U.S. Cl.
CPC ..... *A61H 39/086* (2013.01); *A61H 39/007* (2013.01); *A61H 2201/12* (2013.01);
(Continued)

(58) Field of Classification Search
CPC .... A61H 39/007; A61H 39/086; A61H 39/08; A61H 2201/12; A61H 2201/1215; A61H 2201/50; A61H 39/00; A61H 2201/5043
See application file for complete search history.

(56) References Cited

U.S. PATENT DOCUMENTS 2,009,562 A * 7/1935 Okumura ..... A61H 39/08 606/186
4,139,011 A * 2/1979 Benoit ..... A61H 39/08 606/182

(Continued)

FOREIGN PATENT DOCUMENTS

CN 2108547 U 7/1992
CN 2181282 Y 11/1994

(Continued)

OTHER PUBLICATIONS

Jan. 27, 2016—(WO)—International Search Report and Written Opinion Appn PCT/CN2015/095789 with English Tran.

(Continued)

*Primary Examiner* — Son Dang
(74) *Attorney, Agent, or Firm* — Banner & Witcoff, Ltd.

(57) ABSTRACT

An acupuncture device and a needle wakening method are disclosed. The acupuncture device includes a plurality of acupuncture needles, and each acupuncture needle includes a needle body and a needle handle; an end of the needle body is a needle tip, and the other end of the needle body is fixedly connected with the needle handle. The acupuncture device further includes a driving device, and the driving device includes a driving component and a first timing component; the first timing component is configured for setting an interval of time to start the driving component, and the driving component is configured for driving the acupuncture needle to rotate alternately in forward and reverse directions when the interval of time is arrived.

15 Claims, 5 Drawing Sheets

(52) U.S. Cl.
CPC .. *A61H 2201/1215* (2013.01); *A61H 2201/50* (2013.01); *A61H 2201/5043* (2013.01)

(56) References Cited

U.S. PATENT DOCUMENTS

| | | | | |
|---|---|---|---|---|
| 6,549,810 | B1 * | 4/2003 | Leonard | A61N 1/0551 607/115 |
| 8,932,198 | B1 | 1/2015 | You | |
| 9,636,103 | B2 * | 5/2017 | Penna | A61B 17/0467 |
| 9,827,409 | B1 * | 11/2017 | Evans | A61M 37/0084 |
| 2003/0195542 | A1 * | 10/2003 | Lee | A61M 37/0076 606/186 |
| 2004/0143275 | A1 * | 7/2004 | Chen | A61M 37/0076 606/133 |
| 2007/0129745 | A1 * | 6/2007 | Suh | A61H 39/08 606/189 |
| 2008/0078313 | A1 * | 4/2008 | Hamajima | D05B 11/00 112/117 |
| 2008/0157421 | A1 * | 7/2008 | Mukai | A61H 39/086 264/164 |
| 2008/0306502 | A1 * | 12/2008 | Lisec | A01K 11/005 606/186 |
| 2009/0125050 | A1 * | 5/2009 | Dixon | A61M 37/0076 606/186 |
| 2010/0036317 | A1 * | 2/2010 | Oginski | A61M 37/00 604/131 |
| 2010/0042137 | A1 * | 2/2010 | Oronsky | A61H 39/083 606/204 |
| 2010/0191269 | A1 * | 7/2010 | Kim | A61H 39/08 606/189 |
| 2011/0015712 | A1 * | 1/2011 | Mok | A61H 39/002 607/116 |
| 2011/0048174 | A1 * | 3/2011 | Lin | A61M 37/0084 81/9.22 |
| 2012/0123462 | A1 * | 5/2012 | Lee | A61M 37/0076 606/185 |
| 2014/0290547 | A1 * | 10/2014 | Hasegawa | D05B 37/08 112/102.5 |
| 2015/0352007 | A1 * | 12/2015 | Shayle | A61H 39/086 606/189 |
| 2016/0008535 | A1 * | 1/2016 | Van Thiel | A61M 5/008 604/173 |
| 2018/0055730 | A1 * | 3/2018 | Ding | A61H 39/086 |

FOREIGN PATENT DOCUMENTS

| | | | |
|---|---|---|---|
| CN | 1709215 | A | 12/2005 |
| CN | 201108589 | Y | 9/2008 |
| CN | 103169612 | A | 6/2013 |
| CN | 203139096 | U | 8/2013 |
| CN | 203677534 | U | 7/2014 |
| CN | 104274905 | A | 1/2015 |
| CN | 104784044 | A | 7/2015 |
| CN | 204709386 | U | 10/2015 |
| DE | 3436969 | A1 | 4/1986 |
| JP | 2005027881 | A | 2/2005 |
| KR | 20090012994 | A | 2/2009 |

OTHER PUBLICATIONS

Apr. 28, 2016—(CN)—First Office Action Appn 201510239818.3 with English Tran.

* cited by examiner

ACUPUNCTURE DEVICE AND NEEDLE WAKENING METHOD

The application is a U.S. National Phase Entry of International Application No. PCT/CN2015/095789 filed on Nov. 27, 2015, designating the United States of America and claiming priority to Chinese Patent Application No. 201510239818.3 filed on May 12, 2015. The present application claims priority to and the benefit of the above-identified applications and the above-identified applications are incorporated by reference herein in their entirety.

TECHNICAL FIELD

Embodiments of the present disclosure relate to an acupuncture device and a needle wakening method.

BACKGROUND

The acupuncture medicine is an important part of the Chinese traditional medicine, and is also an important treatment manner of the Chinese traditional therapy, and its most notable feature is that a therapeutic effect can be achieved by simply stimulating specific acupoints of a human body without oral administration of medicine.

During an acupuncture treatment, an acupuncturist needs to apply acupuncture needles to corresponding acupoints of a patient one by one. But after an acupuncture needle is applied into the body for a period of time, the effect will be significantly reduced, and in this case it is further required the acupuncturist to come to waken the needle for the patient, that is, the needle is entwisted, and it is considered that the needle is wakened when the patient has responses such as numbness. This operation is time-consuming, if there are many patients, the doctor cannot take care of all patients at the same time, resulting in relatively low efficiency.

SUMMARY

An embodiment of the present disclosure provides an acupuncture device, and the acupuncture device comprises a plurality of acupuncture needles, each acupuncture needle includes a needle body and a needle handle, an end of the needle body is a needle tip, and the other end of the needle body is fixedly connected with the needle handle; the acupuncture device further comprises a driving device, and the driving device includes a driving component and a first timing component; the first timing component is configured for setting an interval of time to start the driving component; and the driving component is configured for driving an acupuncture needle to rotate alternately in forward and reverse directions when the interval of time is arrived.

For example, the driving device further includes a second timing component, and the second timing component is configured for setting a continuous working time period of the driving component after the driving structure starts.

For example, the driving device further includes an amplitude adjusting component, and the amplitude adjusting component is configured for controlling an amplitude of rotation when the driving component drives the acupuncture needle to rotate alternately in forward and reverse directions.

For example, the driving component includes a connecting plate, a lifting rod and a swing motor, and the lifting rod and the swing motor are connected with the connecting plate; the connecting plate is provided with a first connecting part; the needle handle of each acupuncture needle is provided with a second connecting part; and the first connecting part is capable of being detachably connected with the second connecting part.

For example, the first connecting part is a plurality of hooks arranged on a surface of the connecting plate; the second connecting part is a through hole arranged on the needle handle; or, the second connecting part is a groove arranged on a side edge of the needle handle; and a number of the hooks is greater than a number of the acupuncture needles applied to human acupoints.

For example, the second connecting part includes a groove arranged on a side edge of the needle handle; the hook is made of a ferrous material; a first magnetic coating layer includes arranged on a surface of the groove, or at least the needle handle of the acupuncture needle is made of a magnetic material.

For example, the first connecting part includes a second magnetic coating layer arranged on a surface of the connecting plate; the second connecting part includes a third magnetic coating layer arranged on an end of the needle handle; and the second magnetic coating layer and the third magnetic coating layer are capable of oppositely attracting each other.

For example, the acupuncture needle is provided with a channel internally, an end of the channel is located on a position of the needle tip, and the other end is located on a position of the needle handle.

For example, the channel passes through the needle handle; a cap is further provided on the needle handle, and the gap is configured for covering an opening of the channel on a surface of the needle handle.

For example, a thin film having a micromesh structure and passing the channel is further arranged at a connection between the needle body and the needle handle.

Another embodiment of the present disclosure provides a method for wakening an acupuncture needle by any one of the above acupuncture devices, comprising: receiving a time instruction by the first timing component of the driving device, the time instruction including an interval of time; transmitting a starting instruction to the driving component by the first timing component when the interval of time is arrived; and driving an acupuncture needle connected with the driving component to rotate alternately in forward and reverse directions after the driving component receives the starting instruction.

For example, in a case where the driving component further includes a second timing component, after receiving the starting instruction, operation of driving an acupuncture needle connected with the driving component to rotate alternately in forward and reverse directions after receiving the starting instruction by the driving component, includes: continuously driving an acupuncture needle connected with the driving component to rotate alternately in forward and reverse directions in a range of time set by the second timing component after the driving component receives the starting instruction.

For example, in a case where the driving component further includes an amplitude adjusting component, in a range of time set by the second timing component, with an amplitude value set by the amplitude adjusting component, the driving component continuously drives an acupuncture needle connected with the driving component to rotate alternately in forward and reverse directions.

BRIEF DESCRIPTION OF THE DRAWINGS

In order to clearly illustrate the technical solution in the embodiments of the present disclosure or in the prior art, the drawings necessary for description of the embodiments or the prior art will be briefly described hereinafter; it is obvious that the described drawings are only related to some embodiments of the present disclosure, for which one ordinarily skilled in the art still can obtain other drawings without inventive work based on these drawings.

DETAILED DESCRIPTION

The technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those skilled in the art can obtain other embodiment(s), without any inventive work, which should be within the scope of the present disclosure.

Figure 1:
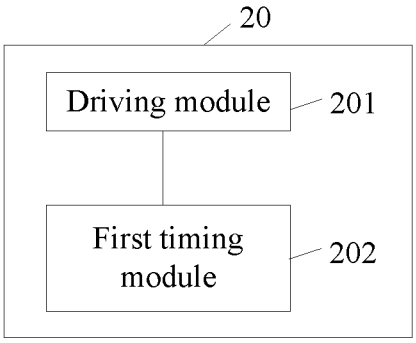
FIG. 1 is a schematic view I of a driving device provided by an embodiment of the present disclosure.
Figure 2:
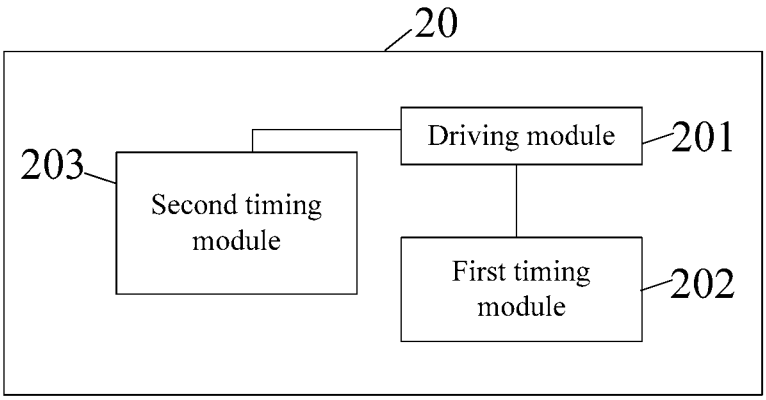
FIG. 2 is a schematic view II of a driving device provided by an embodiment of the present disclosure.
Figure 3:
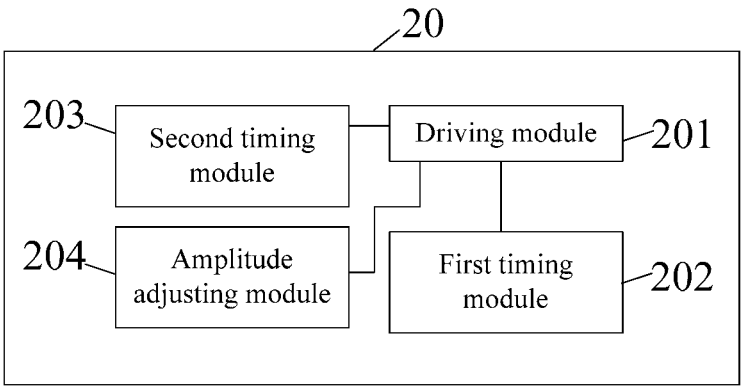
FIG. 3 is a schematic view III of a driving device provided by an embodiment of the present disclosure.

An embodiment of the present disclosure provides an acupuncture device, as illustrated in FIG. 4 to FIG. 9, the acupuncture device 10 comprises a plurality of acupuncture needles 10, each acupuncture needle 10 includes a needle body 101 and a needle handle 102, the tip end of the needle body 101 is a needle tip 1011, and the other end of the needle body 101 is fixedly connected with the needle handle 102; and the acupuncture device further comprises a driving device 20; as illustrated in FIG. 1 to FIG. 3, the driving device 20 includes a driving component 201 and a first timing component 202; the first timing component 202 is configured for setting an interval of time to start the driving component 201, and the driving component 201 is configured for driving the acupuncture needle 10 to rotate alternately in forward and reverse directions when the interval of time is arrived.

In the embodiment of the present disclosure, a rotating button for adjusting an interval of time may be arranged on an outer surface of the driving device 20, and the rotating button is configured for controlling the interval of time set by the first timing component 202, for example, the interval of time may be 10 minutes. In this case, a switch may be further arranged on the outer surface of the driving device 20, and when the switch is opened, timing is running from start till 10 minutes according to the interval of time set by the rotating button.

Of course, a display screen and an adjusting button for performing the function of increasing and decreasing time may be further arranged on the outer surface of the driving device 20, and the adjusting button for increasing and decreasing is configured for controlling the interval of time set by the first timing component 202, and the interval of time may be displayed on the display screen. In this case, a switch may be further arranged on the outer surface of the driving device 20, and when the switch is opened, it starts to count down till 0 according to the interval of time displayed on the display screen.

Based on the above example, when the interval of time is arrived, the first timing component 202, for example, may transmit a starting signal so as to start the driving component 201 to work, thereby driving the acupuncture needle 10 connected with the driving component 201 to rotate alternately in forward and reverse directions for wakening this needle.

In addition, when the interval of time set by the first timing component 202 is arrived, it may be reset by itself for timing again, or may start the process of retiming upon the driving component 201 stopping working.

It should be noted that, firstly, it is preferred that concave-convex rubbing lines are formed on the surface of the needle handle 102, and the concave-convex rubbing lines can help an acupuncturist to hold the needle and perform operations such as twisting.

In addition, a scale line may be further arranged on the needle body 101, so as to accurately control a depth of needling into a body, and avoid effects caused by needling too deep or too shallow.

Secondly, for fixedly connecting the needle body 101 with the needle handle 102, a part of the needle body 101 may be stretched into the needle handle 102 so as to closely connect the needle body 101 and the needle handle 102 with each other, or the two components may be integrally formed, and ways for connecting is not specifically limited here.

Thirdly, the first timing component 202 is configured for setting an interval of time to start the driving component 201, that is, the driving component 201 starts once again after every an interval of time, for example, if the interval of time is 10 minutes, the driving component 201 starts to work once again every 10 minutes.

Thus, when the driving component 201 starts to work, a specific working time period thereof is not limited.

Fourthly, in the embodiment of the present disclosure, the acupuncture needle 10 rotates alternately in forward and reverse directions, which is equal to twisting in manual operation; an amplitude of rotating in a forward direction, i.e., an angle rotated in the forward direction, and an amplitude of rotating in a reverse direction, i.e., an angle rotated in the reverse direction, are not limited.

Fifthly, in the embodiment of the present disclosure, the driving component 201 drives an acupuncture needle 10 to rotate alternately in forward and reverse directions when working, and therefore it is necessary to connect the driving component 201 with the acupuncture needle 10; however, considering that it is inconvenient for an acupuncturist to apply the needle to a patient if the acupuncture needle 10 is connected with the driving component 201, and thus all acupuncture needles 10 may be connected with the driving component 201 after being applied to the body of the patient according to needs.

The connecting mode between the acupuncture needle 10 and the driving component 201 is not limited by the embodiment of the present disclosure, as long as the driving component 201 can drive the acupuncture needle 10 to twist when working.

An embodiment of the present disclosure provides an acupuncture device, and an interval of time is set by the first timing component 202, so that the driving component 201 starts to work for driving the acupuncture needle to rotate alternately in forward and reverse directions when the interval of time is arrived, thereby realizing the function of wakening the needle automatically.

Optionally, as illustrated in FIG. 2 and FIG. 3, the driving device 20 further includes a second timing component 203, and the second timing component 203 is configured for setting a continuous working time period of the driving component 201 after starting.

Herein, a button for adjusting the working time when the driving component 201 starts may be arranged on an outer surface of the driving device 20, and a time value set by the second timing component 203 may be controlled by rotating the button.

Of course, a display screen and an adjusting button for increasing and decreasing time may be further arranged on the outer surface of the driving device 20, and the adjusting button of increasing and decreasing may control a time value set by the second timing component 203, and the time value is displayed on the display screen.

Further, as illustrated in FIG. 3, the driving device 20 further includes an amplitude adjusting component 204, and the amplitude adjusting component 204 is configured for controlling the amplitude of rotation when the driving component 201 drives the acupuncture needle to rotate alternately in forward and reverse directions.

Herein, a button for adjusting the amplitude of rotation when the driving component 201 drives the acupuncture needle to rotate alternately in forward and reverse directions may be further arranged on the outer surface of the driving device 20, and the amplitude value set by the amplitude adjusting component 204 can be controlled by rotating the button. The amplitude value is a range of angle rotated in a forward direction, or a range of angle rotated in a reverse direction.

Of course, a display screen and an adjusting button of increasing and decreasing may be further arranged on the outer surface of the driving device 20, and the adjusting button of increasing and decreasing may control an amplitude value set by the amplitude adjusting component 204, and the amplitude value is displayed on the display screen.

Figure 4:
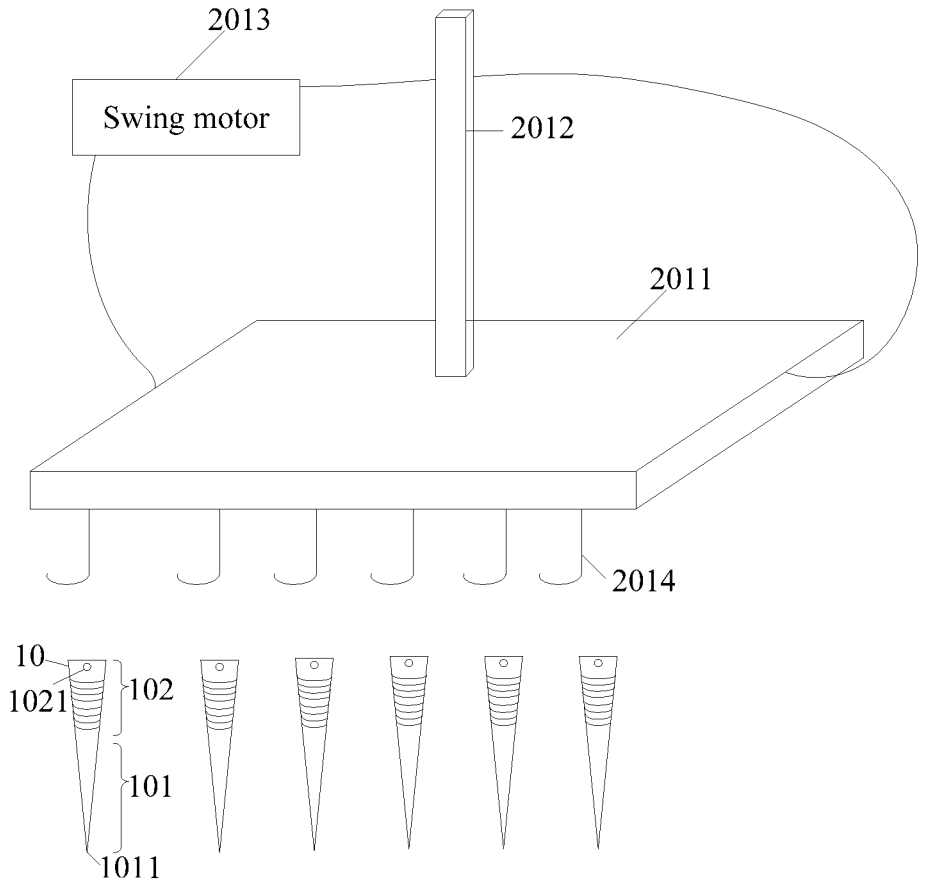
FIG. 4 is a schematic view I of an acupuncture device provided by an embodiment of the present disclosure.
Figure 5:
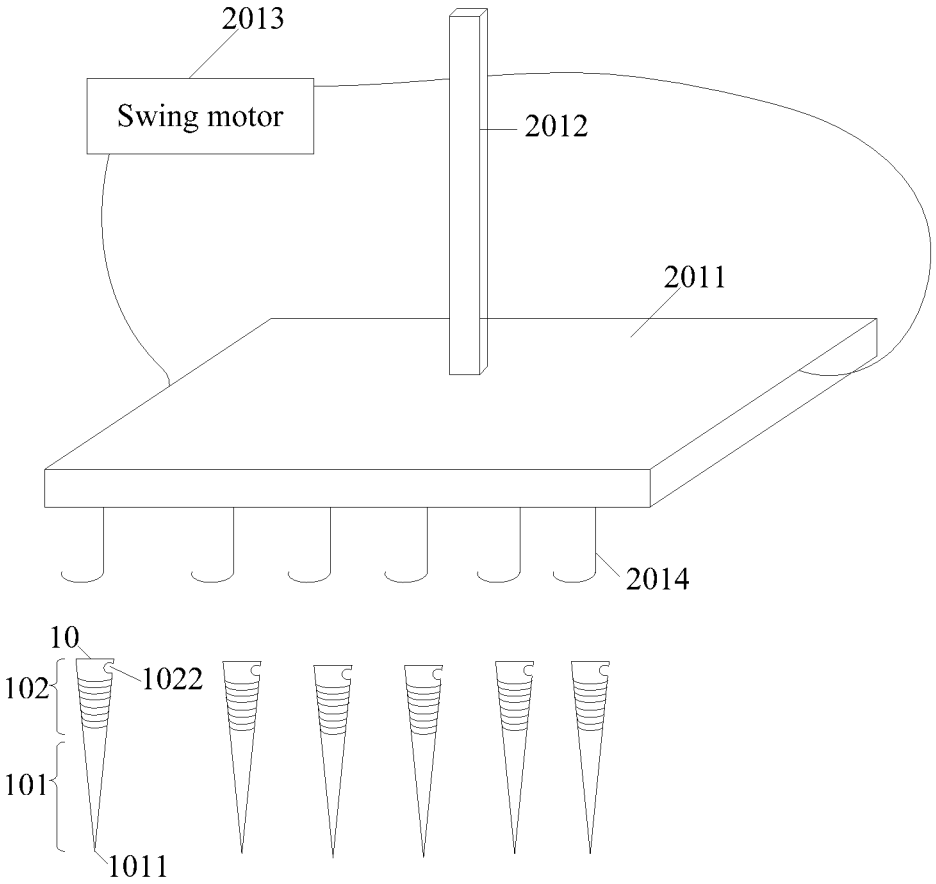
FIG. 5 is a schematic view II of an acupuncture device provided by an embodiment of the present disclosure.
Figure 6:
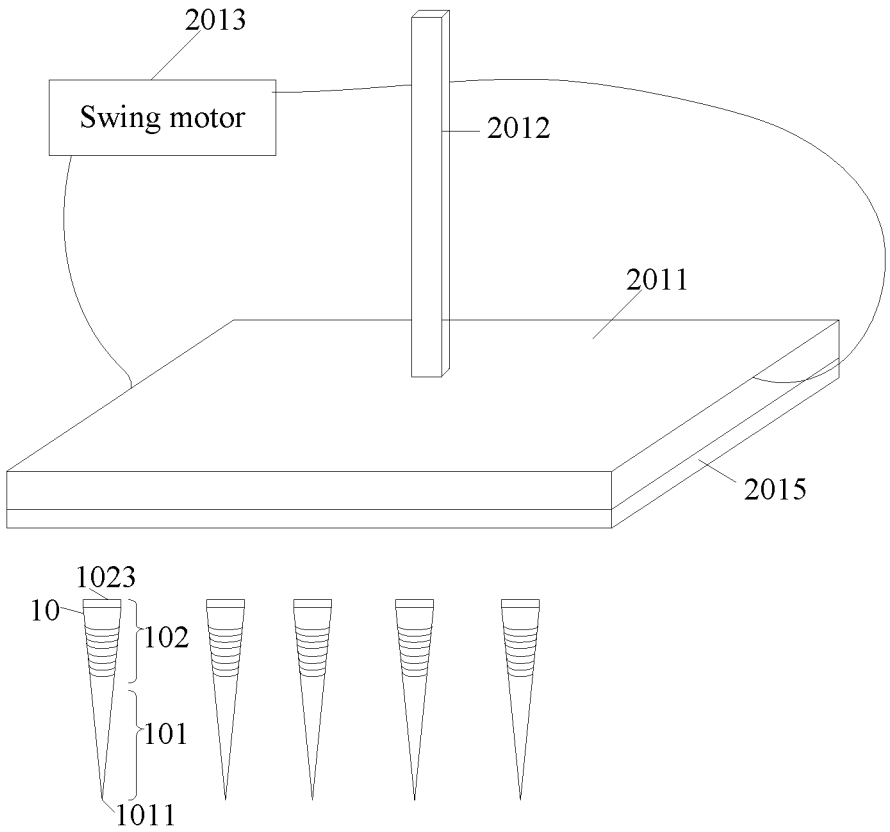
FIG. 6 is a schematic view III of an acupuncture device provided by an embodiment of the present disclosure.

Optionally, as illustrated in FIG. 4 to FIG. 6, the driving component 201 includes a connecting plate 2011, and includes a lifting rod 2012 and a swing motor 2013 which are connected with the connecting plate 2011. The connecting plate 2011 is provided with a first connecting part, and a needle handle 102 of each acupuncture needle 10 is provided with a second connecting part; the first connecting part is capable of being detachably connected with the second connecting part.

Herein, the swing motor 2013 is configured for the motor which can rotate alternately in forward and reverse directions when working.

The connecting plate 2011, for example, may be connected with the swing motor 2013 through two connecting lines, so as to be driven by the swing motor 2013 to rotate alternately in forward and reverse directions. The lifting rod 2012 may be arranged above the connecting plate 2011, and in this way the connecting plate 2011 can be prevented from generating a gravitational force on the acupuncture needle 10 by adjusting the lifting rod 2012 so as to prevent the gravitational force from acting on a human body, and also prevent the acupuncture needle 10 from being pulled out by a pulling force caused by the gravitational force on the acupuncture needle 10.

Further optionally, as illustrated in FIG. 4 to FIG. 5, the first connecting part includes a plurality of hooks 2014 arranged on the surface of the connecting plate 2011; the second connecting part includes a through hole 1021 arranged on the needle handle 102; or, the second connecting part is a groove 1022 arranged on a side edge of the needle handle 102; the number of the hooks 2014 is greater than the number of the acupuncture needles 10 applied to human acupoints, and for example the groove 1022 is preferred a C-shaped groove.

Herein, after an acupuncturist applies an acupuncture needle 10 into a corresponding acupoint of a human body, the connecting plate 2011 may be close to the human body by adjusting the lifting rod 2012, so that the hooks 2014 arranged thereon pass the through hole 1021 or the groove 1022 of each acupuncture needle 10, thereby realizing connecting the acupuncture needle 10 with the connecting plate 2011.

It should be noted that, the number of the hooks 2014 arranged on the connecting plate 2011 may be greater than the number of the acupuncture needles 10 applied to the human acupoints, so that there is always a hook 2014 vertically corresponding to an acupuncture needle 10 no matter where it is so that it can pass the through hole 1021 or the groove 1022, thereby preventing the acupuncture needle 10 from being pulled.

Further, it is preferred that the second connecting part is a groove 1022 arranged on a side edge of the needle handle 102, and in this way, the hook 2014 may enter from an opening of the groove 1022 to facilitate the hook 2014 entering and withdrawing.

In this way, preferably, the hook 2014 is made of a ferrous material, and a first magnetic coating layer is arranged on a surface of the groove 1022; or at least the needle handle 102 of the acupuncture needle 10 is made of a magnetic material.

In this way, with a suction of the magnetic material, when the acupuncture needle 10 rotates alternately in forward and reverse directions, the hook 2014 may be prevented from falling off the opening of the groove 1022.

For example, as illustrated in FIG. 6, the first connecting part includes a second magnetic coating layer 2015 arranged on a surface of the connecting plate 2011; the second connecting part includes a third magnetic coating layer 1023 arranged on an end of the needle handle 102; the second magnetic coating layer 2015 and the third magnetic coating layer 1023 oppositely attract each other.

The acupuncture needle 10 may be connected with the connecting plate 2011 through mutual attraction between the second magnetic coating layer 2015 arranged on the connecting plate 2011 and the third magnetic coating layer 1023 arranged on the end of the needle handle 102.

Here, the end is the other end of the acupuncture needle 10 opposite to the needle tip 1011.

Figure 7:
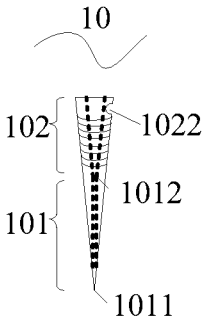
FIG. 7 is a schematic view I of an acupuncture needle provided by an embodiment of the present disclosure.

Based on the above description, optionally, as illustrated in FIG. 7, the acupuncture needle 10 is provided with a channel 1012 internally; an end of the channel 1012 is located at the position of the needle tip 1011, and the other end is located at the position of the needle handle 102.

Herein, the channel 1012 may pass through the whole needle handle 102 as illustrated in FIG. 7. Of course, the channel 1012 may only pass through an end of the needle handle 102 connected with the needle body 101, and not pass through the other end of the needle handle 102; further, another through hole perpendicular to the channel 1012 may be arranged on the needle handle 102, and the another through hole is connected with the channel 1012, and in this way, a drug may be injected into the channel 1012.

In this way, the drug may be imported or injected into a corresponding acupoint of a patient while the patient is undergoing the treatment of acupuncture, so that the therapeutic effect can be enhanced.

Figure 8:
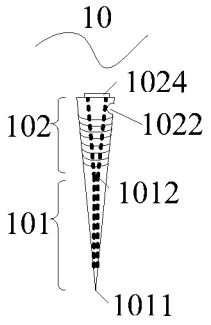
FIG. 8 is a schematic view II of an acupuncture needle provided by an embodiment of the present disclosure.

Further, as illustrated in FIG. 8, the channel 1012 passes through the needle handle 102; a cap 1024 is further provided on the needle handle 102, and the gap 1024 is configured for covering an opening of the channel 1012 on a surface of the needle handle 102.

That is, the channel 1012 passes from the needle tip 1011 to the needle handle 102; it can be seen from an outer surface of the acupuncture needle 10 that an opening is present on the surface of the needle handle 102; thus, in order to prevent the drug injected into the channel 1012 from overflowing, the cap 1024 is configured for covering the opening located on the surface of the needle handle 102.

Figure 9:
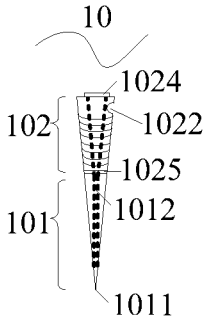
FIG. 9 is a schematic view III of an acupuncture needle provided by an embodiment of the present disclosure.

Further, as illustrated in FIG. 9, a thin film 1025 having a micromesh structure and passing the channel 1012 is further arranged on the connection of the needle body 101 and the needle handle 102.

The micromesh of the thin film 1025 may be selected as 200 meshes, 400 meshes and so on according to the particle size of the drug.

Herein, the purpose of arranging the thin film 1025 includes that, when the frequency of the acupuncture needle 10 rotating alternately in forward and reverse directions is up to a certain threshold, the drug may enter into a human body after being injected into the channel 1012 in the needle body 101, so that a better therapeutic effect can be obtained.

Based on the above description, the acupuncture device may further comprise a vibrating module and at least one connecting line; the at least one connecting line is configured for connecting the acupuncture needle 10 and the vibrating module, so that the vibrating module may be started to drive the acupuncture needle 10 to vibrate if necessary.

The acupuncture needle 10 is provided with a through hole 1021 as illustrated in FIG. 4 or a groove 1022 as illustrated in FIG. 5, so as to connect the vibrating module with at least one connecting line.

Further, the other structures of the acupuncture needle 10 may be referred to the above structures, which will not be repeated here.

Figure 10:
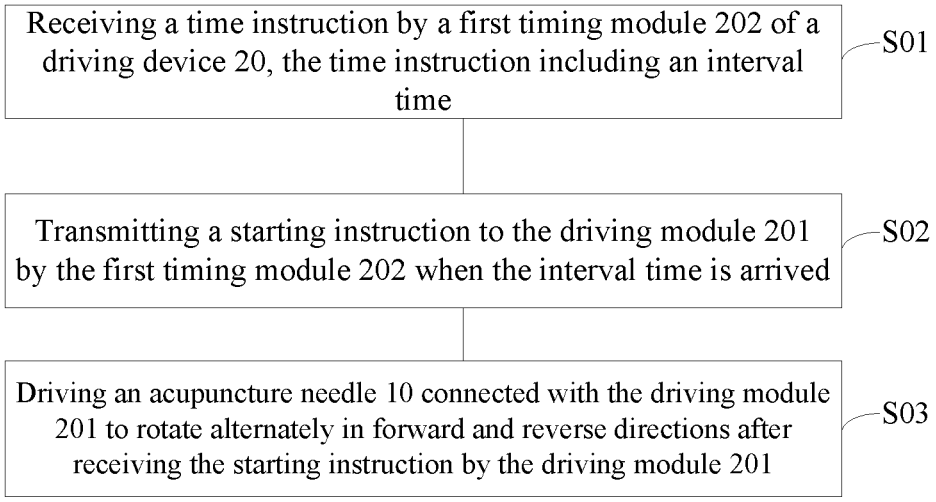
FIG. 10 is a flow chart of a needle wakening method provided by an embodiment of the present disclosure.

An embodiment of the present disclosure further provides a method for wakening an acupuncture needle in operation by using the acupuncture device described above; as illustrated in FIG. 10, the method comprises operations of:

S01: receiving a time instruction by a first timing component 202 of a driving device 20, the time instruction including an interval of time.

Here, a rotating button for adjusting an interval of time may be arranged on the outer surface of the driving device 20, and the rotating button is configured for controlling an interval of time set by the first timing component 202, for example, the interval of time may be 10 minutes. In this case, for example, when a switch arranged on the outer surface of the driving device 20 is opened, the time instruction set by the rotating button is transmitted to the first timing component 202.

Of course, a display screen and an adjusting button of increasing and decreasing may be further arranged on an outer surface of the driving device 20, and the adjusting button of increasing and decreasing is configured for controlling an interval of time set by the first timing component 202, and the interval of time may be displayed on the display screen. In this case, for example, when a switch arranged on the outer surface of the driving device 20 is opened, the time instruction set by the rotating button is transmitted to the first timing component 202.

In addition, when the interval of time set by the first timing component 202 is arrived, it may be reset by itself for retiming, or may start retiming upon the driving component 201 stopping working.

S02: transmitting a starting instruction to the driving component 201 by the first timing component 202 when the interval of time is arrived.

Here, the first timing component 202 may perform forward timing till the predetermined interval of time, for example, 10 minutes, is arrived, or may perform backward timing till the predetermined interval of time to be 0.

S03: driving an acupuncture needle 10 connected with the driving component 201 to rotate alternately in forward and reverse directions after receiving the starting instruction by the driving component 201.

Here, when the driving component 201 starts to work, a specific working time period is not limited.

An embodiment of the present disclosure provides a needle wakening method, an interval of time is set by the first timing component 202, so that the driving component 201 starts to work for driving the acupuncture needle 10 to rotate alternately in forward and reverse directions when each interval of time is arrived, thereby realizing wakening the needle automatically.

Further, in the case where the driving component 20 further includes a second timing component 203, the operation of driving an acupuncture needle 10 connected with the driving component 201 to rotate alternately in forward and reverse directions after receiving the starting instruction by the driving component 201, includes: continuously driving an acupuncture needle 10 connected with the driving component 201 to rotate alternately in forward and reverse directions in a range of time set by the second timing component 203 after receiving the starting instruction by the driving component 201.

Here, a button for adjusting a working time when the driving component 201 starts may be arranged on an outer surface of the driving device 20, and a time value set by the second timing component 203 may be controlled by rotating the button.

Of course, a display screen and an adjusting button of increasing and decreasing may be further arranged on the outer surface of the driving device 20, and the adjusting button of increasing and decreasing can control the time value set by the second timing component 203, and the time value is displayed on the display screen.

Further, in a case where the driving component 20 further includes an amplitude adjusting component 204, in a range of time set by the second timing component 203, with an amplitude value set by the amplitude adjusting component 204, the driving component 201 continuously drives an acupuncture needle 10 connected with the driving component 201 to rotate alternately in forward and reverse directions.

Herein, a button for adjusting an amplitude of rotation when the driving component 201 drives the acupuncture needle 10 to rotate alternately in forward and reverse directions may be further arranged on an outer surface of the driving device 20, and the amplitude value set by the amplitude adjusting component 204 may be controlled by rotating the button.

Of course, a display screen and an adjusting button of increasing and decreasing may be further arranged on an outer surface of the driving device 20, and the adjusting button of increasing and decreasing may control an amplitude value set by the amplitude adjusting component 204, and the amplitude value is displayed on the display screen.

The foregoing embodiments merely are exemplary embodiments of the present disclosure, and not intended to define the scope of the present disclosure, and the scope of the present disclosure is determined by the appended claims.

The present application claims priority of Chinese Patent Application No. 201510239818.3 filed on May 12, 2015, the disclosure of which is incorporated herein by reference in its entirety as part of the present application.

What is claimed is:

1. An acupuncture device, comprising a plurality of acupuncture needles, each acupuncture needle comprising a needle body and a needle handle, an end of the needle body being a needle tip, and the other end of the needle body being fixedly connected with the needle handle; wherein the acupuncture device further comprises a driving device, and the driving device comprises a driving component and a first timing component;

the first timing component is configured for setting an interval of time to start the driving component;

the driving component is configured for driving an acupuncture needle to rotate alternately in forward and reverse directions when the interval of time is arrived;

the driving component comprises a connecting plate, a lifting rod and a swing motor, and the lifting rod and the swing motor are connected with the connecting plate;

the connecting plate is provided with a first connecting part, and the needle handle of each acupuncture needle is provided with a second connecting part;

the first connecting part is capable of being detachably connected with the second connecting part;

the first connecting part comprises a plurality of hooks arranged on a surface of the connecting plate connected to the plurality of acupuncture needles;

the second connecting part comprises a through hole arranged on the needle handle; or, the second connecting part comprises a groove arranged on a side edge of the needle handle; and a number of the hooks is greater than a number of the acupuncture needles applied to human acupoints.

2. The acupuncture device according to claim 1, wherein the driving device further comprises a second timing component, and the second timing component is configured for setting a continuous working time period of the driving component after the driving component starts.

3. The acupuncture device according to claim 2, wherein the driving device further comprises an amplitude adjusting component, and the amplitude adjusting component is configured for controlling an amplitude of rotation when the driving component drives the acupuncture needle to rotate alternately in forward and reverse directions.

4. The acupuncture device according to claim 3, wherein the acupuncture needles are each provided with a channel internally, an end of the channel is located on a position of the needle tip, and the other end is located on a position of the needle handle.

5. The acupuncture device according to claim 2, wherein the acupuncture needles are each provided with a channel internally, an end of the channel is located on a position of the needle tip, and the other end is located on a position of the needle handle.

6. The acupuncture device according to claim 5, wherein the channel passes through the needle handle; and a cap is further provided on the needle handle, and the cap is configured for covering an opening of the channel on a surface of the needle handle.

7. The acupuncture device according to claim 5, wherein a thin film having a micromesh structure and passing the channel is further arranged at a connection between the needle body and the needle handle.

8. The acupuncture device according to claim 1, wherein the second connecting part comprises a groove arranged on a side edge of the needle handle;

the hook is made of a ferrous material; and a first magnetic coating layer is arranged on a surface of the groove, or at least the needle handle of the acupuncture needle is made of a magnetic material.

9. The acupuncture device according to claim 1, wherein the first connecting part comprises a second magnetic coating layer arranged on a surface of the connecting plate;

the second connecting part comprises a third magnetic coating layer arranged on an end of the needle handle; and the second magnetic coating layer and the third magnetic coating layer are capable of oppositely attracting each other.

10. The acupuncture device according to claim 1, wherein the acupuncture needles are each provided with a channel internally, an end of the channel is located on a position of the needle tip, and the other end is located on a position of the needle handle.

11. The acupuncture device according to claim 10, wherein the channel passes through the needle handle; and a cap is further provided on the needle handle, and the cap is configured for covering an opening of the channel on a surface of the needle handle.

12. The acupuncture device according to claim 10, wherein a thin film having a micromesh structure and passing the channel is further arranged at a connection between the needle body and the needle handle.

13. A method for wakening an acupuncture needle by the acupuncture device according to claim 1, comprising:

receiving a time instruction by the first timing component of the driving device, the time instruction comprising an interval of time;

transmitting a starting instruction to the driving component by the first timing component when the interval of time is arrived; and driving the acupuncture needle connected with the driving component to rotate alternately in forward and reverse directions after the driving component receives the starting instruction.

14. The method according to claim 13, wherein in a case where the driving component further comprises a second timing component, after the driving component receives the starting instruction, operation of driving the acupuncture needle connected with the driving component to rotate alternately in forward and reverse directions after receiving the starting instruction by the driving component, comprises:

continuously driving the acupuncture needle connected with the driving component to rotate alternately in forward and reverse directions in a range of time set by the second timing component after the driving component receives the starting instruction.

15. The method according to claim 14, wherein in a case where the driving component further comprises an amplitude adjusting component, in a range of time set by the second timing component, with an amplitude value set by the amplitude adjusting component, the driving component continuously drives an acupuncture needle connected with the driving component to rotate alternately in forward and reverse directions.

* * * * *